US009061315B1

(12) United States Patent
Griglak et al.

(10) Patent No.: US 9,061,315 B1
(45) Date of Patent: Jun. 23, 2015

(54) APPARATUS, SYSTEM AND METHOD FOR PAINTING A SURFACE

(71) Applicants: Pavel Griglak, Bridgeview, IL (US); Maria Griglakova, Bridgeview, IL (US)

(72) Inventors: Pavel Griglak, Bridgeview, IL (US); Maria Griglakova, Bridgeview, IL (US)

( * ) Notice: Subject to any disclaimer, the term of this patent is extended or adjusted under 35 U.S.C. 154(b) by 0 days.

(21) Appl. No.: 14/448,212

(22) Filed: Jul. 31, 2014

(51) Int. Cl.

| | |
|---|---|
| ***B05C 1/06*** | (2006.01) |
| ***B05D 1/28*** | (2006.01) |
| *B05C 17/02* | (2006.01) |
| *B05C 17/035* | (2006.01) |

(52) U.S. Cl.
CPC ... *B05C 1/06* (2013.01); *B05D 1/28* (2013.01); *B05C 17/0222* (2013.01); *B05C 17/0242* (2013.01); *B05C 17/0355* (2013.01)

(58) Field of Classification Search
CPC ..... B05C 17/0242; B05C 17/0222; B05C 17/0225; B05C 17/0355
USPC ..... 401/13–15, 208, 218, 5
See application file for complete search history.

(56) References Cited

U.S. PATENT DOCUMENTS

| | | | | |
|---|---|---|---|---|
| 691,184 | A * | 1/1902 | Shickler | 401/35 |
| 849,777 | A * | 4/1907 | Freestate | 401/48 |
| 1,881,597 | A * | 10/1932 | Hoyos | 401/193 |
| 2,548,580 | A * | 4/1951 | Bick | 101/331 |
| 2,577,339 | A | 12/1951 | Lee | |
| 2,797,427 | A | 7/1957 | Tate | |
| 2,824,325 | A | 2/1958 | Lussier | |
| 2,837,757 | A | 6/1958 | Katanich | |
| 2,936,474 | A | 5/1960 | Custer | |
| 3,023,443 | A * | 3/1962 | Brandeis | 15/230.11 |
| 3,160,909 | A * | 12/1964 | Nelkin | 401/15 |
| 3,213,477 | A * | 10/1965 | Shafer | 15/248.2 |
| 3,263,263 | A | 8/1966 | Munn | |
| 3,346,899 | A * | 10/1967 | Murphy | 15/118 |
| 3,457,582 | A * | 7/1969 | Fisher | 15/248.2 |
| 3,708,821 | A | 1/1973 | Chase et al. | |
| 3,942,209 | A * | 3/1976 | Walls | 15/118 |
| 4,012,152 | A * | 3/1977 | Lupkes | 401/218 |
| 4,102,302 | A | 7/1978 | Amberg et al. | |
| 4,122,799 | A | 10/1978 | Ortega | |
| 4,268,184 | A * | 5/1981 | Sheck et al. | 401/218 |
| 4,424,603 | A | 1/1984 | Balint et al. | |
| 4,555,195 | A * | 11/1985 | deVreeze et al. | 401/218 |
| 4,630,952 | A * | 12/1986 | Elbaum | 401/48 |
| 5,209,781 | A | 5/1993 | Milkie | |
| 5,386,610 | A | 2/1995 | Batanjski | |
| 5,702,525 | A * | 12/1997 | Liou | 401/218 |
| 5,857,795 | A * | 1/1999 | Liou | 401/218 |
| 6,554,902 | B2 | 4/2003 | Yan | |
| 7,340,796 | B2 | 3/2008 | Pyles | |
| 8,540,449 | B2 * | 9/2013 | Song | 401/218 |
| 2004/0211016 | A1 * | 10/2004 | Pyles | 15/114 |
| 2008/0142648 | A1 | 6/2008 | Rabi et al. | |

* cited by examiner

*Primary Examiner* — David Walczak
*Assistant Examiner* — Bradley Oliver
(74) *Attorney, Agent, or Firm* — Patents+TMS, P.C.

(57) ABSTRACT

A painting tool has a handle with a trough attached to the handle. The trough has walls and a base that defines an interior that holds paint. A sponge assembly with a sponge that paints a surface is attached to the painting tool by a rivet. The sponge is fixed to the sponge assembly by fastener that rotates around the rivet. A wheel rotates in the trough to collect and transfer the paint from the trough to the sponge assembly. A first side and a second side parallel to the first side are attached to the handle and the trough. An arm holding a swipe that cleans the surface is attached to the trough.

30 Claims, 7 Drawing Sheets

APPARATUS, SYSTEM AND METHOD FOR PAINTING A SURFACE

BACKGROUND OF THE INVENTION

The present invention generally relates to an apparatus, a system and a method for painting a surface, such as a wall. More specifically, the apparatus, system and method relate to painting a wall at a part where the wall meets a ceiling.

Painting a room is often done to enhance the appearance of a room. Often, walls of the room are painted one color, and a ceiling is painted a second color. Painters often struggle to quickly and/or accurately paint the "trim" of the wall where the wall meets the ceiling. Conventional paint rollers may contact the ceiling when painting sections of the wall close to the ceiling resulting in paint on the roller to touch the ceiling. Paint brushes, rollers and/or sprayers often result with the same problem and/or are time consuming to complete the painting of the trim.

Traditional paint applicators, such as rollers, sprayers and other related devices, may be configured to apply paint over a broad area. As a result, paint may be applied to surfaces that are not intended to be painted.

Other devices may use wide rollers to apply paint to a wall more efficiently. Such wide rollers are unable to paint areas of a wall at or near a ceiling of a room. Thus, a need exists for a painting tool that may paint an area of a wall near a ceiling without painting the ceiling. This invention seeks to meet that need and to overcome the drawbacks commonly associated with known painting tools.

SUMMARY OF THE INVENTION

The present invention generally relates to an apparatus, a system and a method for applying paint to a surface, such as a wall. More specifically, the invention relates to a painting tool which assists with painting a wall at an area where the wall meets the ceiling.

To this end, a painting tool, such as a housing in the shape of a box, enclosing a trough may be provided. The trough holds paint with a wheel that rotates to collect and store paint from the trough and transfers the paint to a sponge held in a sponge assembly. The sponge contacts the wheel and rotates, along with the wheel, upon movement of the hand painting tool against the wall. The sponge may be compressed against a wall to paint the wall at a junction point just below the ceiling without painting the ceiling. The wheel may be textured and/or have indentations to avoid the collection and/or accumulation of excess paint on the wheel.

An arm with a swipe may be positioned adjacent to the sponge assembly to clean and/or clear the ceiling of any paint that may contact the ceiling during the painting process. Similarly, a flap may be positioned below the arm to collect paint that may drip from the swipe. Guide wheels at the top of the device may roll against the ceiling to maintain a distance of the painting tool from the ceiling. Two other guide wheels may be located on side panels of the painting tool so that the device moves along the wall. A user, either left handed or right handed, may position the device on the wall and move the device to paint the wall.

In an embodiment, an apparatus may be provided for painting a surface, such as a wall. The apparatus has a handle with a trough attached to the handle. The trough holds paint, and a notch is cut from an interior surface of the trough. A support post may be inserted into the notch in the trough. A sponge assembly may be attached to a cross-beam that spans the length of the apparatus. A wheel may rotates axially about the support post to collect paint in the trough and to transfer the paint to a sponge held in the sponge assembly. The apparatus may be positioned against a point on a wall near a ceiling, for example, to paint the wall by pressing and/or rolling the sponge against the wall.

In an embodiment, a system may be provided for painting a surface, such as a wall. The system may have a device positioned against an area on a wall near a ceiling. Rollers on the device position the device a set distance below the ceiling. Paint may be applied from a a sponge held in a sponge assembly and/or pad that may rotate axially about a rivet on the device to contact the wall. Paint may be stored in a container attached to the device. Rotation of the sponge about the rivet may, in turn, rotate a wheel in the container. The wheel may collect paint and transfer it to the sponge to provide the sponge assembly with a supply of paint.

In an embodiment, a method may be provided for painting a surface, such as a wall. The method may require positioning a painting tool with a sponge assembly at an area of a wall near a ceiling, and rolling a sponge held in the sponge assembly in a direction parallel to the ceiling to apply paint. The sponge may rotate upon contacting the wall to paint a line with a defined width, for example. Rotation of the sponge may, in turn, rotate an internal wheel of the painting tool that contacts the sponge to collect paint from the painting tool. The wheel, upon further rotation, may then return the paint to the sponge to replenish the sponge with paint.

Accordingly, it is an advantage of the present invention to provide an apparatus, a system and a method for applying paint to a surface, such as a wall.

Another advantage of the present invention is to provide an apparatus, a system and a method for applying paint to a surface from a painting tool with sides that enclose a trough holding paint.

Yet another advantage of the present invention is to provide an apparatus, a system and a method for applying paint to a surface from a painting tool with an arm to swipe off excess paint from the surface.

An additional advantage of the present invention is to provide an apparatus, a system and a method for applying paint to a surface that may be hand-held.

An additional advantage of the present invention is to provide an apparatus, a system and a method for applying paint to a surface with a tool that may be grasped by a user who is either left handed or right handed.

Still another advantage of the present invention is to provide an apparatus, a system and a method for applying paint to a surface with a tool that may be transported.

A further advantage of the present invention is to provide an apparatus, a system and a method for applying paint to a surface for small scale painting operations and/or home users.

A still further advantage of the present invention is to provide an apparatus, system and method for applying paint to a wall of a room at a point beneath a ceiling of the room.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

In the following detailed description, reference is made to accompanying figures, which form a part hereof. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented. It will be readily understood that the aspects of the present disclosure, as generally described herein, and illustrated in the figures, may be arranged, substituted, combined and designed in a wide variety of different configurations, which are explicitly contemplated and form part of this disclosure.

Figure 1:
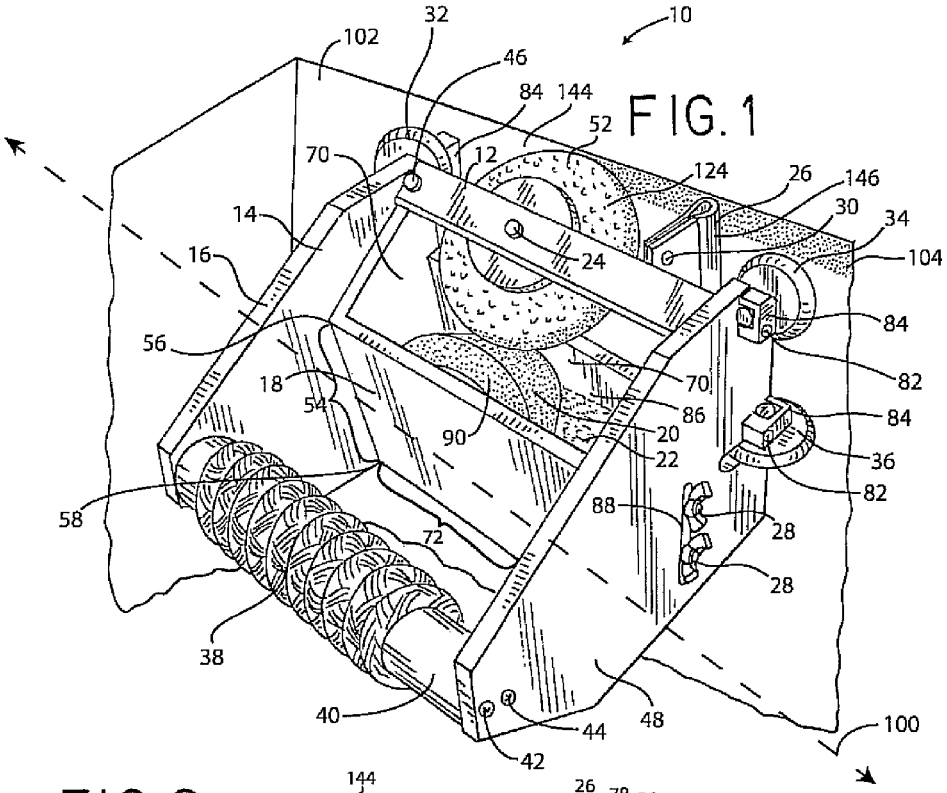
FIG. 1 illustrates a perspective view of the painting tool in use in accordance with embodiments disclosed herein.
Figure 3:
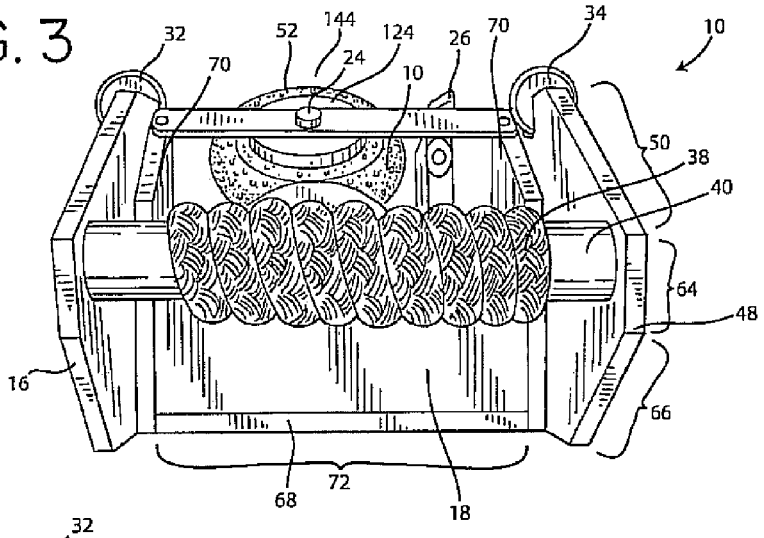
FIG. 3 illustrates a front view of the painting tool in accordance with embodiments disclosed herein.

Referring now to FIG. 1, a perspective view of a painting tool 10 is shown. In an embodiment, the painting tool 10 is generally formed as a box having a first side 16 and a second side 48 that may be attached to a handle 40. The first side 16 and the second side 48 may be shaped as a trapezoid and may be constructed from one or more rigid materials, such as wood, metal and/or plastic. The materials may be selected to maintain the shape and structure of the painting tool 10. As shown, the painting tool 10 may have a trough 18 having a width 72 defined as the distance from the first side 16 to the second side 48 and a height defined as the distance of a top edge 56 of the trough 18 to a bottom edge 58 of the trough 18. The trough 18 may have a rigid base 68 as shown in FIG. 3 extending lengthwise from the first side 16 to the second side 48. The trough 18 may be formed by the juncture of separate trough side panels, or may be integrally formed as a single piece with several interior surfaces 70, as shown in FIG. 1.

Paint 22, for example household wall paint, may be poured into and/or stored in the trough 18 as shown in FIG. 1. A support post 94 may be inserted through a center hole of a wheel 20 to rest in a notch 106 that may be formed in the interior surfaces 70 of the trough 18. The wheel 20 may rotate in either a clock-wise direction and/or counter-clockwise direction around the support post 94 within the trough 18 to contact, collect and/or the accumulate the paint 22 on a surface 90 of the wheel 20.

The surface 90 may be, for example, textured to assist in the operation of the wheel 20, namely to improve contact, collection and/or accumulation of the paint 22 on the wheel 20. However, thicker and/or relatively more viscous paint may be resistant toward adhesion to and/or collection by the wheel 20. The texture, such as indentations, of the surface 90 may provide an additional surface area for the paint 22 to contact and adhere to, for example. Thus, the ability of the wheel 20 to accumulate and/or store the paint 22 may be improved by the texture of the wheel 20.

The notch 106 may extend downward from the top edge 56 of the trough 18 toward the bottom edge 58 of the trough 18. The support post 94 may move in the upward direction and/or downward direction within the notch 106 to facilitate rotation of the wheel 20 as needed to contact, collect and/or accumulate the paint 22 within the trough 18.

As shown in FIG. 1, a handle 40, such as a rigid cylinder constructed from plastic, for example, extends from the first side 16 to the second side 48. The handle 40 may be wrapped by a rope, or one or more other similar strings, such as a cord, a twine, and/or a wire to create a grip 38. A user of the painting tool, such as an amateur home painter, may grasp the grip 38 of the handle 40 with either hand to use the painting tool 10.

Figure 2:
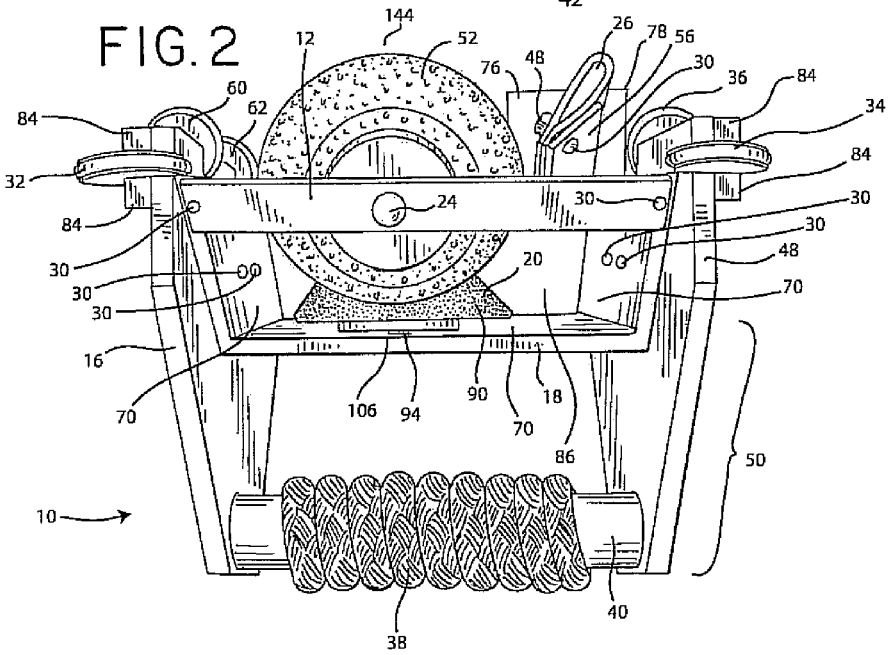
FIG. 2 illustrates a top view of the painting tool in accordance with embodiments disclosed herein.
Figure 6:
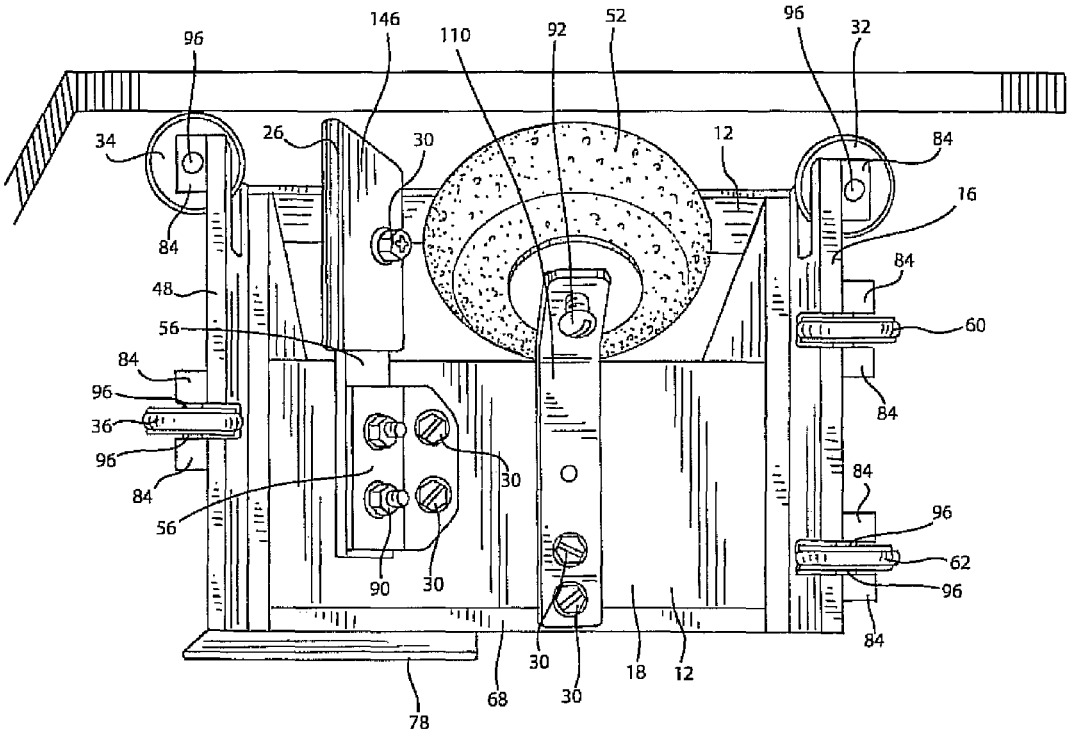
FIG. 6 illustrates a rear view of the painting tool in accordance with embodiments disclosed herein.

As shown in FIG. 2, a cross-beam 12 extends from the first side to the second side 48. The cross-beam 12 may be constructed from one or more materials, such as plastic, metal and/or wood. A rivet 92 as shown in FIG. 6 may connect a sponge assembly 144 to the cross-beam 12.

Figure 7:
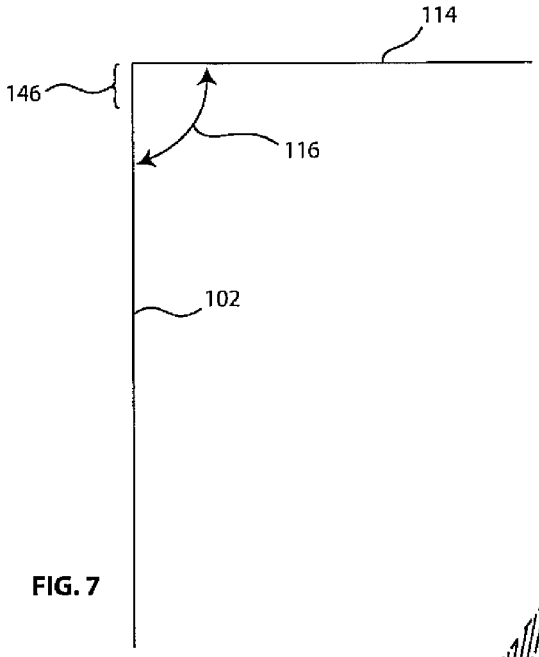
FIG. 7 illustrates a side view of a wall and a ceiling where the wall is positioned at an angle perpendicular to the ceiling.
Figure 8:
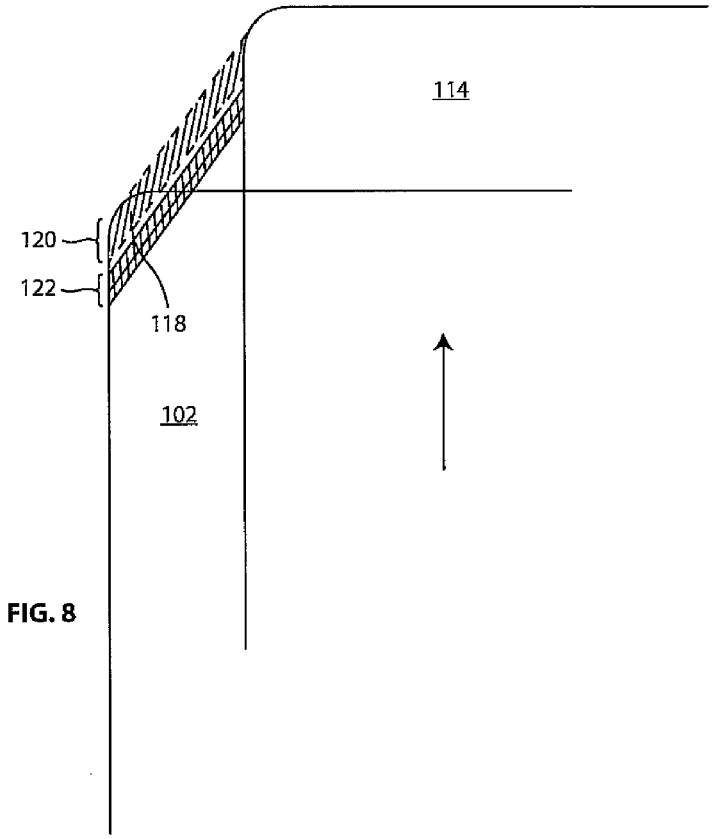
FIG. 8 illustrates a perspective view of a wall and a ceiling where the juncture between the wall and the ceiling is curved.

As shown in FIGS. 1-9 and 9-14, a sponge 52 held in the sponge assembly 144 may be shaped as truncated cone. In an embodiment, the sponge 52 may be made from, for example, a porous material suited to clean and/or absorb water, oil, and/or the paint 22. The porous material may be made from cellulose fibers and/or from foamed plastic polymers, for example. The sponge 52 may have a thickness of, for example, approximately three-quarters of an inch. Compression and rotation of the sponge 52 against a wall 102 as shown in FIG. 1 may allow the paint 22 to transfer from the sponge 52 to the wall 102 at a area 122 near a ceiling 114 as shown in FIGS. 7 and 8, for example. A user of the painting tool 10 such as a painter may roll the painting tool 10 along the wall 102 to paint, for example, a line on the wall 102 at a point near the ceiling 114. The painter may select a thicker and/or thinner sponge 52 to be inserted in the sponge assembly 144 to paint an area 122 as shown in FIG. 8 line on the wall of a desired width.

Figure 4:
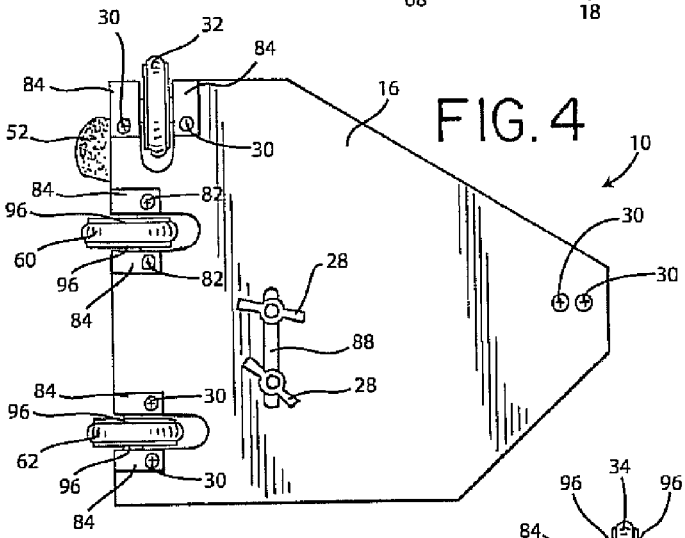
FIG. 4 illustrates a side view of the painting tool in accordance with embodiments disclosed herein.
Figure 5:
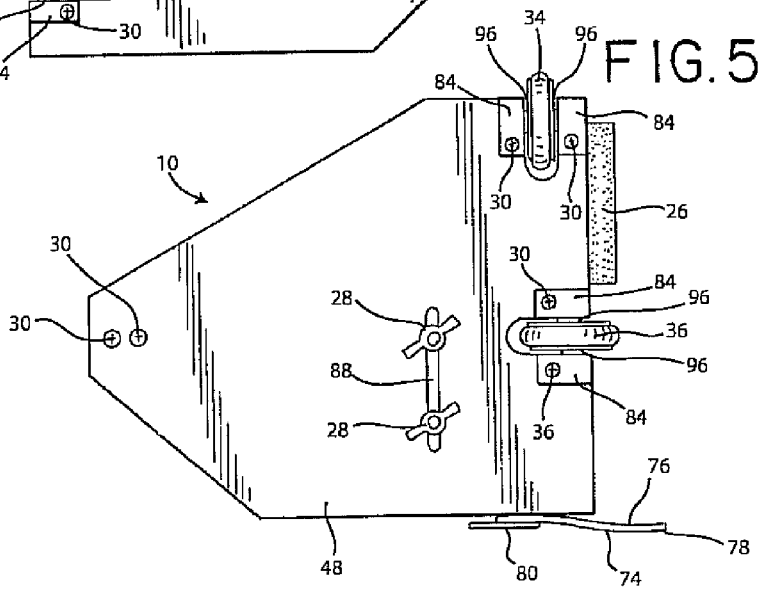
FIG. 5 illustrates another side view of the painting tool in accordance with embodiments disclosed herein.

An end-cap 24 may hold the rivet 92 in place. A screw 30 may bind the cross-beam 12 to the trough 18 on the left side and the right side of the trough 30. The screws 30 may penetrate through an elongated cut-out 88 in the left side 16 and the right side 48 of the painting tool 10 to attach the trough 18 to the left side 16 and the right side 48. A wing nut 28, as shown in FIGS. 4 and 5, may rotate in a clockwise direction around the screws 30 to attach the left side 16 and the right side 48 to the trough 18 at a given vertical position. Thus, as shown in FIG. 1, the trough 18 may be positioned higher and/or lower, as needed to shift and/or orient the sponge 52 of the sponge assembly 144 closer to and/or further away from the ceiling 114.

A first ceiling guidance wheel 32 may be attached to the painting tool 10 on the first side 16 via a mount 84 that may hold an internal axle 96, such as a wooden post. Similarly, a second ceiling guidance wheel 34 may be mounted on the second side 48 of the painting tool 10 via another mount 84. The first ceiling guidance wheel 32 and the second ceiling guidance wheel 34 may contact a ceiling of a room, for example, when the painting tool 10 is held against, for example, a region of a wall 102 at or near the ceiling as shown in FIG. 1. A right-side top wall guidance wheel 60, a right-side bottom wall guidance wheel 62, and a left-side wall guidance wheel 36, as shown in FIGS. 4 and 5 may contact and rotate against the section of the wall 102 upon placement of the painting tool 10 as described above. A user, for example, may grasp the grip 38 of the handle 40 of the painting tool 10 as shown in FIG. 1 to position the painting tool 10 at a region of the wall 102 near the ceiling 114 to initiate applying paint to the wall 102.

For example, the first ceiling guidance wheel 32 and the second ceiling guidance wheel 34 may rotate against the ceiling 114 while the right-side top wall guidance wheel 60, the right-side bottom wall guidance wheel 62, and the left-side wall guidance wheel 36 may rotate against the wall 102. Thus, the painting tool 10 may move along a region of the wall 102 near the ceiling 114 in a direction of motion 100 as shown in FIG. 1 to the left and/or to the right, as desired.

As shown in FIG. 1, the trough 18 may hold the paint 22. A user, for example, may position the painting tool 10 against the wall 102 to contact and/or compress the sponge 52 of the sponge assembly 144 against the wall 102. The sponge 52 may rotate around the rivet 92 as shown in FIG. 6 in either a clock-wise direction or counter-clockwise direction dependent on the direction of motion 100, e.g., to the right, or to the left, respectively. The sponge 52 may contact the wheel 20 where rotational motion of the sponge assembly 144 may rotate the wheel 20 around the support post 94 as shown in FIG. 2 to allow the wheel 20 to collect and/or store the paint 22 from the trough 18. Further rotational motion of the sponge 52 along the wall 102 during movement of the painting tool 10 may rotate the wheel 20 to transfer and/or distribute the paint 22 on the sponge 52. As shown in FIGS. 1-6, the positioning and/or angled orientation, for example, of the wheel 20 in the trough 18 that may be filled with the paint 22 may permit for the sponge 52 to be automatically replenished with the paint 22 during movement of the painting tool 10 along the wall 102. In detail, the sponge 52 may rotate around the rivet 92 to apply the paint 22 to the wall 102. The sponge 52 may contact the wheel 20, as shown in FIGS. 1-6, and rotation of the sponge 52 may rotate the wheel 20 to collect the paint 22 from the trough 18 and transfer the paint 22 to the sponge 52. Thus, the paint 22 may be continuously supplied by the wheel 20 to replenish the sponge 52 with paint 22 since the sponge assembly may eventually dry out and/or be depleted of the paint 22 after applying the paint 22 to the wall 102.

As shown in FIGS. 1-6, the thickness and/or depth of the sponge 52 may match, or be less than, the thickness of the wheel 20. Such a configuration may ensure, for example, an uninterrupted transfer of the paint 22 from the wheel 20 to the sponge 52 while minimizing spillage of the paint 22 from the sponge 52 outside the trough 18.

The sponge 52 with the paint 22 that may be dispersed on the sponge 52 may contact and/or may roll against the wall 102 as shown in FIG. 1 to produce a line 104 of paint 22 on the wall 102 beneath the ceiling 114. The height and/or position of the wheel 20 in the trough 18 within the painting tool 10 may be adjusted relative to the sponge assembly 144 by the movement of the screws 30 that may be inserted in the cut-out 88, as shown in FIGS. 1, 4 and 5. For example, the trough 18 may be shifted in an upward vertical direction and/or a downward vertical direction within the painting tool 10 to allow for a desired compression of the sponge 52 against the wheel 20. Application of a thick, heavy, and/or highly viscous paint 22 on the wall 102 may, for example, require positioning of the wheel 20 further beneath the sponge 52 to avoid unwanted build-up and/or splatter of the paint 22 when the wheel 20 transfer the paint 22 to the sponge 52. In contrast, application of a thin, light and/or less viscous paint 22 on the wall 102 may, for example, require positioning of the wheel 20 closer to the sponge assembly 144 to achieve maximum compression of the sponge 52 against the wheel 20. Such a high compression may protect against unwanted run-off of thin paint 22 during the transfer of the thin paint 22 from the wheel 20 to the sponge 52.

As shown in FIGS. 1 and 2, an arm 56 may hold a swipe 26 by a screw, such as, for example, the screw 30, that is threaded through the arm 56 and may be held by a nut 48. The swipe 26 may feature a rubber interior surface and/or a fabric exterior surface, for example. The arm 56 with the swipe 26 may be positioned adjacent to the sponge assembly 144 to clean and/or "swipe-off" the wall 102 resulting from any excess paint 22 from the sponge 52 that may touch the wall 102 while painting the wall 102 with the painting tool 10. Excess paint may be cleaned from the wall 102 and/or the ceiling 114 by the swipe 26 and may fall and/or drip downward toward a floor, for example. The swipe 26 may be made from a flexible and/or absorbent material, such as a cotton and/or synthetic cloth, for example, and may be folded as shown in FIGS. 1 and 2.

Similarly, an extension flap 78 may be positioned at a point below the arm 56 and may collect the paint 22 that may drip in a direction downward from the swipe 26. Paint 22 may accumulate on the extension flap 78 that may later be cleaned off by a user as desired.

Referring now to FIG. 3, the grip 38 on the handle 40 is illustrated. In the embodiment shown by FIG. 3, the grip 38 may be made from a coiled rope, for example. The grip 38 may be selected from various materials, such as rope, coil, twine, padding and the like. The grip 38 may provide a comfortable surface that may allow a painter to hold and/or to use the painting tool 10 in a stable manner for an extended period of time, if necessary. The first side 16 and the second side 48 may be attached to a right side and a left side of the handle 40, respectively. The first side 16 and the second side 48 may have edges, such as a top edge 50 and a bottom edge 66, that may be separated by a mid-section 64. As shown in FIG. 3, the top edge 50 and the bottom edge 66 may be different lengths and/or angles. For example, the top edge 50 may be the longest edge, with a shorter bottom edge 66 and a shorter mid-section 64. The configuration of a longer top edge 50 and a shorter bottom edge 66 that may be separated by a short mid-section 62 may allow for the handle 40 to counter balance the weight of the trough 18. As the trough 18 is filled with paint 22, the trough 18 may become heavier and thus may cause the painting tool 10 to become imbalanced, i.e. the painting tool 10 will be relatively heavier toward the trough 18 filled with paint 22. A user of the painting tool 10, such as a painter, may grasp the handle 40 by the grip 38 to lift the painting tool 10 to counter balance the weight of the trough 18 in the painting tool 10. Further, the handle 40 may be positioned parallel to the trough 18. As a result, the user may lift the painting tool 10 without tipping the painting tool 10 that may cause the paint 22 to spill from the trough 18.

Referring now to FIGS. 4 and 5, the painting tool 10 may have various mounts 84 that may be attached to the painting tool 10 via the screws 30 which may insert into the first side 16 and the second side 48. Internal axles 96 may thread between the mounts 84 to allow the wheels 32, 24, 60, 62 and 36 to rotate in a direction of desired motion. The trough 18 may be attached to the first side 16 and the second side 48 via the screws 30 that may be inserted through the cut-out 88 of the left side 16 and the right side 48 of the painting tool 10. The trough 18 may be adjusted in the upward vertical direction or the downward vertical direction relative to the left side 16 and the right side 48 of the painting tool 10 by positioning the screws 30 and/or tightening the wing nut 28. The handle 40 may attach to and may be fixed in position between the first side 16 and the second side 40 by the screws 30.

As illustrated in FIG. 6, a central support bracket 110 may be mounted on a rear panel 112 of the trough 18. The central support bracket 110 may be constructed from any suitable rigid material, or combination thereof, such as, for example, metal, plastic and/or wood. The central support bracket 110 may connect to a the trough 18, a floor panel 68 of the trough 18, and to the sponge assembly 144. The sponge assembly 144 may be held in place by a rivet 92 that may allow the sponge 52 to rotate around the river 92. The rivet 92 may connect the cross-beam 12 to the central support bracket 110. The rivet 92 may be held in place by an end-cap 24. The swipe 26 may be folded and attached to the arm 56 by the screw 30. The arm 56 may be mounted to the rear panel 112 of the trough 18 by a brace 94. The brace 94 may protrude from the rear panel 118 at an angle to position the swipe 26 that may be adjacent to the sponge assembly 144.

Referring now to FIG. 7, the painting tool 10 may be positioned against the wall 102 that may be in a room, for example. The wall 102 may be oriented at an angle 116 that may be, for example, a right, or ninety degree, angle to the ceiling 114. Such an orientation of the wall 102 relative to the ceiling 114 may be more common in rooms in older homes, for example. Accordingly, reaching and/or applying paint 22 to a region 146 of the wall 102 near to and/or in contact with the ceiling 114 may be difficult due to, for example, the orientation of the wall 102 relative to the ceiling 114 at the angle 116.

In contrast, rooms in newer homes may feature the wall 102 connected to the ceiling along a joint, for example with a gradual angle 118 as shown in FIG. 8. The gradual angle 118 has no sharp edge as, for example, the region 146 as shown in FIG. 7. Thus, a user of the painting tool 10 such as a painter, for example, may choose to apply the paint 22 to an area 122 at a distance of approximately one-sixteenth of an inch to a quarter of an inch beneath the gradual angle 118. The paint 22 may be applied by rotating the sponge 52 of the painting tool 10 alongside the wall 102 at the area 122 to paint, for example, a straight and/or a uniform line of a given color in the area 122. The paint 22 may be applied on the wall 102 up to the area 122 to paint the wall 102 a single solid color, for example.

Figure 9:
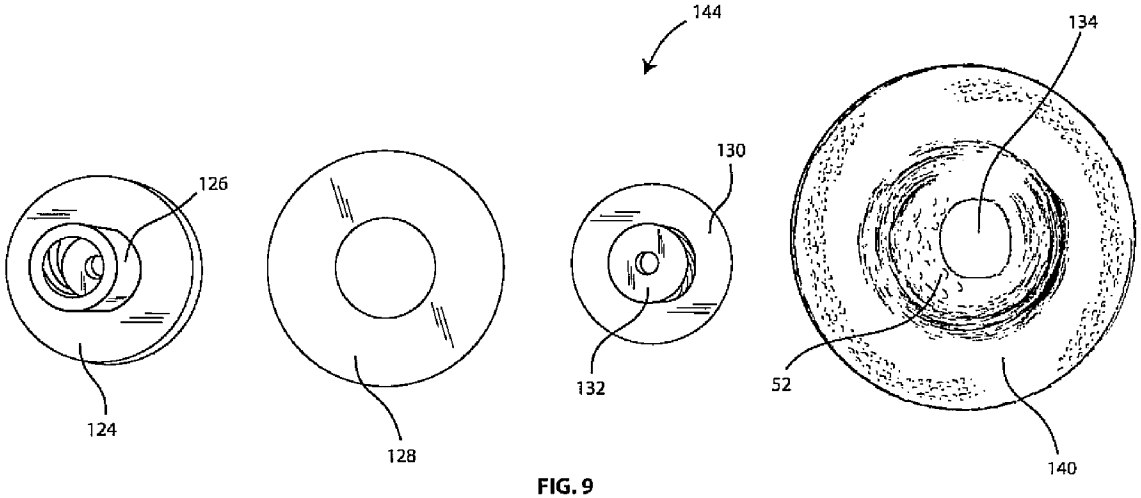
FIG. 9 illustrates a top view of each of the components of a sponge assembly as disassembled.
Figure 10:
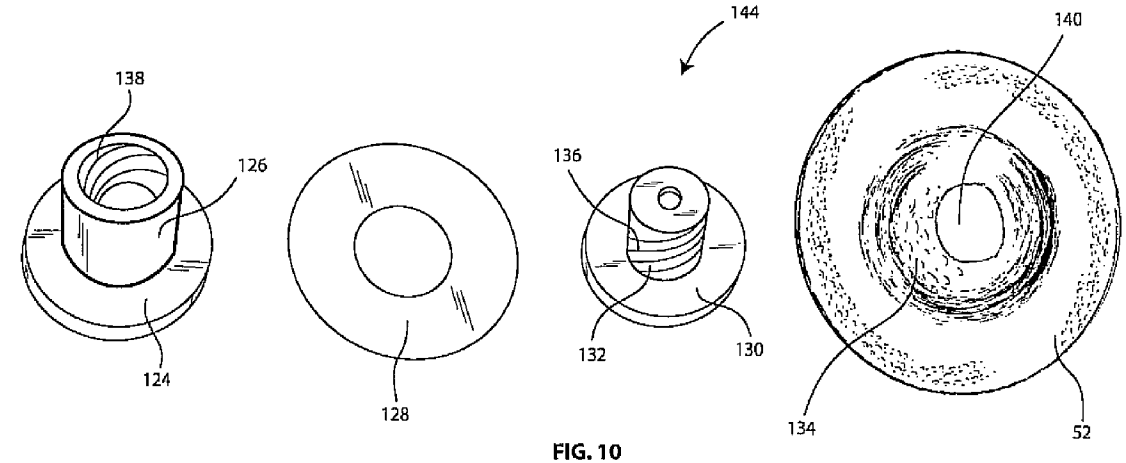
FIG. 10 illustrates a perspective view of each of the disassembled components.

As illustrated in FIGS. 9 and 10, the sponge assembly 144 may be disassembled in various components including a sponge 52, a fastener 130, a receptacle 124, and a lock ring 128. The sponge 52 may be made of a compressible and/or porous material suited to clean and/or absorb water, oil, and/or the paint 22. The porous material of the sponge 52 may be made from cellulose fibers and/or from foamed plastic polymers, for example. Each of the fastener 130, the receptacle 124, and the lock ring 128 may be constructed from plastic, metal, wood and/or any other suitable rigid material or from a composite and/or blend of rigid materials.

The sponge 52 may be formed generally in the shape of a truncated cone such that an edge of the sponge may contact the wall 102 to apply the paint 22 to the wall 102. The fastener 130 may be circular, for example and have a cylindrical mid-section 132 that extends lengthwise away from the fastener 130. The cylindrical mid-section 132 of the fastener 130 may have external threads 136 that radially protrude from, encompass and/or wrap around the cylindrical mid-section 132. The receptacle 132 may have a column 126 extending lengthwise away from the receptacle 132. The column 126 may have internal threads 148 on and/or along an inner surface of the column 126. The internal threads 148 may be configured to receive and/or reversibly interlock with the external threads 136 of the fastener 130. The lock ring 128 may be generally circular in shape and feature a circular cut-out at a center of the lock ring 128.

Figure 11:
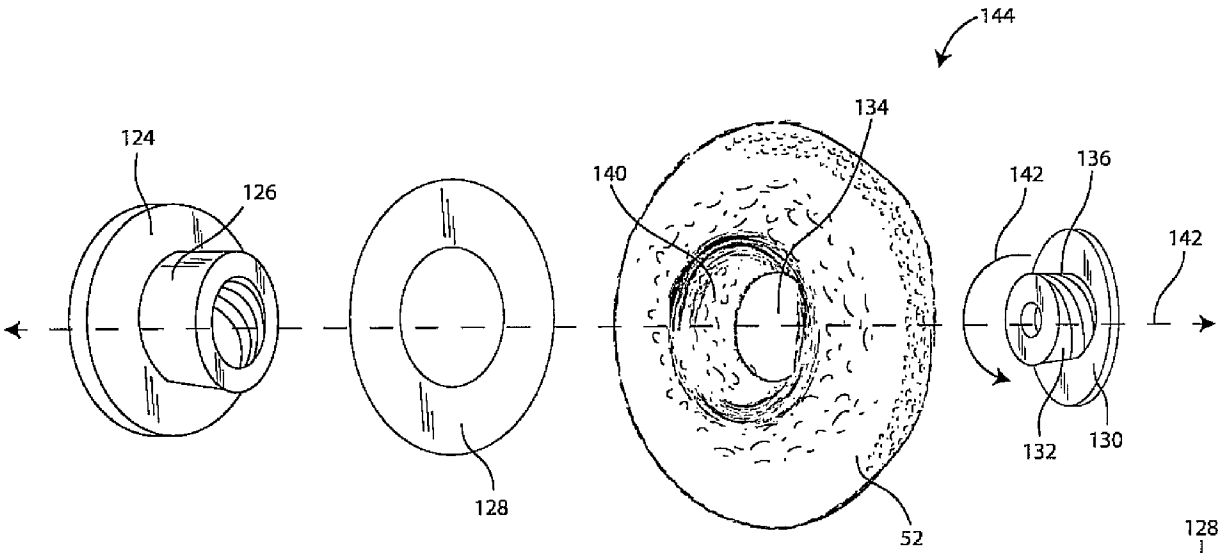
FIG. 11 illustrates an exploded view of the components of a sponge assembly along an axis.

Referring now to FIG. 11, an exploded view of the sponge assembly 144 with the receptacle 124, the lock ring 128, the sponge 52 and the fastener 130. The components may be combined, attached, connected, coupled and/or assembled in the direction and/or order shown in FIG. 11. For example the receptacle may thread and/or be inserted into the locking 128. The receptacle 124 and the lock ring 128 may both feed, thread and/or insert into the sponge 52 in and/or at an orifice 134 with an interior surface 140. The column 126 of the receptacle 124, for example with an exterior surface 150, may contact the interior surface 140 of the sponge 52.

Figure 12:
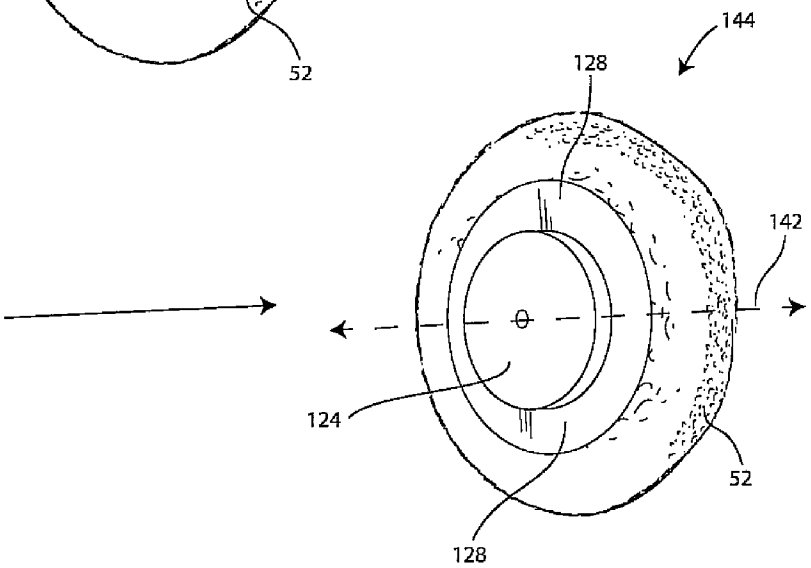
FIG. 12 illustrates a perspective view of the sponge assembly with the components assembled.

To complete the sponge assembly 144, the fastener 130 may be inserted into a rear of the orifice 134 as shown in FIG. 11. The fastener 130 may compress against the sponge 52 to, for example, thread, connect, and/or couple the mid-section 132 of the fastener 130 in and/or against the column 126. The external threads 136 of the fastener may, for example, feed into and/or reversibly interlock with the internal threads of the column to produce, for example, the sponge assembly 144 as shown in FIG. 12.

Figure 13:
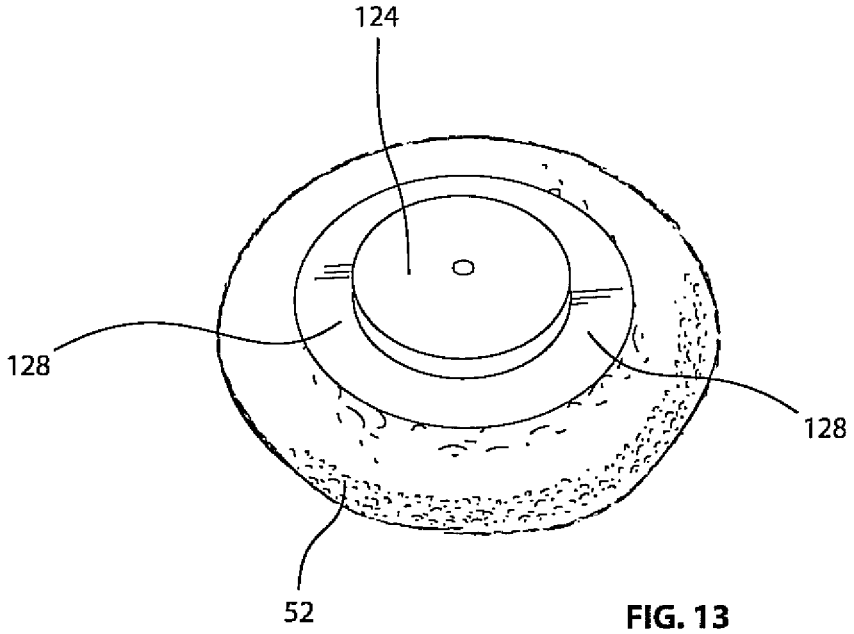
FIG. 13 illustrates another perspective view of the sponge assembly with the components assembled.
Figure 14:
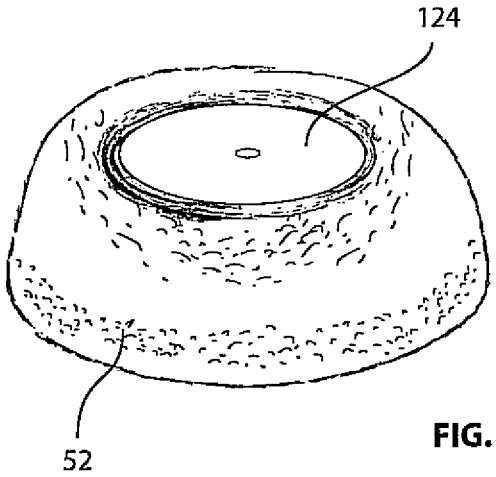
FIG. 14 illustrates yet another perspective view of the sponge assembly with the components assembled.

As illustrated in FIGS. 13 and 14, the sponge assembly 144 is shown assembled. FIG. 13 illustrates a top perspective view of the receptacle 124 and the lock ring 128 that may insert, attach, and/or mount to the sponge 52 to, for example, complete the sponge assembly 144. FIG. 14 illustrates a bottom perspective view of the fastener 130 that may feed into and/or reversibly interlock with the sponge 52 and the receptacle 124 and the lock ring 128 as shown in FIG. 13 to, for example, complete the sponge assembly 144.

As illustrated in FIGS. 1-14, a user of the painting tool 10, such as a painter, for example, may use the painting tool 10 to apply the paint 22 to the wall 102 to form, for example, the line 104 at a point near the ceiling 114. The sponge assembly 144 may be mounted on the central support bracket 110 under the cross-beam as shown in FIGS. 1-6. The paint 22 may be poured into the trough 18 to, for example, at least partially fill the trough 18 with the paint 22. The grip 38 of the handle 40 may be grasped and/or held, for example, by either a right hand or a left hand. The painting tool 10 may be lifted and/or positioned at a region on the wall 102 near the ceiling 114 to contact and/or compress a sponge 52 of the sponge assembly 144 against the wall 102. The first ceiling guidance wheel 32 and the second ceiling guidance wheel 34 may rotate against the ceiling 114 while the sponge 52, the right-side top wall guidance wheel 60, the right-side bottom wall guidance wheel 62, and the left-side wall guidance wheel 36 may rotate against the wall 102 to allow, for example, a person such as a painter, to move the painting tool 10 in the direction of travel 100. For example, the direction of travel 100 may be to the left relative to the wall 102 and/or to the right relative to the wall 102.

The sponge 52 may compress and/or may rotate against the wall 102 to apply the paint 22 upon movement of the painting tool 10 in the direction of travel 100. The sponge 52 may contact and/or may rotate the wheel 20 mounted on the support post 94. The wheel 20 may rotate to collect the paint 22 from the trough 18. The wheel with the paint 22 may rotate and/or contact the sponge 52 to transfer and/or to replenish, for example, the paint 22 to the sponge 52. Additional rotation of the sponge 52 generally in the direction 100 may further rotate the wheel 20 to collect additional paint 22 from the trough 18. The paint 22 may be poured into the trough 18 as needed to replenish the trough 18 with the paint 22.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

We claim:

1. An apparatus comprising:

a handle;

a trough attached to the handle wherein the trough has walls and a base defining an interior that holds paint;

a sponge assembly attached to the trough; and a wheel that rotates in the trough to collect the paint from the trough and to transfer the paint to the sponge assembly wherein the sponge assembly paints a surface; and a flap attached to the trough wherein the flap is positioned toward the surface to capture an excess of the paint.

2. The apparatus of claim 1 further comprising:

a sponge fixed to the sponge assembly that rotates around a rivet wherein the rivet is attached to the trough.

3. The apparatus of claim 1 further comprising:

sides that attach to the trough and the handle.

4. The apparatus of claim 1 further comprising:

an arm extending from the trough wherein a swipe is secured to the arm.

5. The apparatus of claim 1 further comprising:

a swipe attached to the trough wherein the swipe is positioned adjacent to the sponge assembly.

6. The apparatus of claim 1 further comprising:

a grip wrapped around the handle.

7. The apparatus of claim 1 further comprising:

a cross-beam extending across the trough wherein a rivet attaches the sponge assembly to the cross-beam.

8. The apparatus of claim 1 further comprising:

a support post inserted into a notch formed in the trough wherein the wheel rotates around the support post.

9. The apparatus of claim 1 further comprising:

a guide wheel attached to the trough wherein the guide wheel rolls against a ceiling to maintain a distance of the painting tool from the ceiling.

10. The apparatus of claim 1 further comprising:

a mount attached to the trough wherein a guide wheel rotates about an axis in the mount.

11. A system for applying paint to a surface, comprising:

a chamber with panels that define an interior wherein the interior holds paint;

a first side and a second side wherein the first side and the second side are attached to the panels of the chamber;

a cross-beam extending across the chamber;

an arm attached to the trough wherein the arm extends toward the surface;

a pad attached to the cross-beam, a wheel mounted in the chamber wherein the wheel accumulates the paint from the chamber and transfers the paint to the pad wherein the pad applies the paint to the surface; and a swipe secured to the arm wherein the swipe contacts the paint applied to the surface.

12. The system of claim 11 further comprising:

guide wheels attached to the first side and the second side.

13. The system of claim 11 further comprising:

a handle extending from the first side to the second side.

14. The system of claim 11 further comprising:

a rivet attached to the cross-beam wherein the pad is fixed to a fastener that rotates around the rivet.

15. The system of claim 11 further comprising:

a support post that connects the chamber to the cross-beam.

16. The system of claim 11 further comprising:

a wing nut that attaches the first side and the second side to the panels of the chamber.

17. The system of claim 11 further comprising:

cut outs on the first side and the second side wherein the cut outs receive screws that position the chamber relative to the first side and the second side.

18. The system of claim 11 further comprising:

a flap attached to the chamber wherein the flap is located below the arm.

19. A method for painting a surface of a room having walls and a ceiling, the method comprising the steps of:

contacting a sponge assembly of a painting tool against the wall to rotate the sponge assembly;

rotating a wheel adjacent to the sponge assembly wherein the wheel is positioned in a trough attached to the painting tool;

collecting paint stored in the trough on the wheel;

transferring the paint from the wheel to the sponge assembly;

rotating the sponge assembly against the wall to transfer the paint from the sponge assembly to the wall forming a line of paint on the wall; and contacting a swipe to the line of paint wherein the swipe is connected to the trough.

20. The method of claim 19 further comprising:

positioning a painting tool on the wall beneath the ceiling.

21. The method of claim 19 further comprising:

rolling the painting tool along the wall to rotate the sponge assembly along the wall.

22. The method of claim 19 further comprising:

assembling the sponge assembly by inserting a fastener into an orifice of a sponge.

23. The method of claim 19 further comprising:

replenishing the sponge assembly with the paint from the painting tool.

24. The method of claim 19 further comprising:

cleaning the paint from the ceiling while moving the painting tool against the ceiling.

25. The method of claim 19 further comprising:

attaching the sponge assembly to the painting tool.

26. The method of claim 19 further comprising:

accumulating the paint as the paint drips from the surface.

27. A method for painting a wall of a room having a ceiling, the method comprising the steps of:

positioning a painting tool against the wall wherein the painting tool has a trough with paint in the trough;

rotating a sponge assembly within the trough to accumulate the paint on the sponge assembly;

transferring the paint from the sponge assembly to the wall forming a line of paint on the wall that is substantially parallel to the ceiling; and contacting a swipe to the line of paint wherein the swipe extends from the trough.

28. The method of claim 27 further comprising:

cleaning the paint from the ceiling by the painting tool.

29. The method of claim 27 further comprising:

adjusting height of a container mounted in the painting tool.

30. The method of claim 27 further comprising:

pouring paint in the trough of the painting tool.

* * * * *